US007549415B2

(12) United States Patent
Karellas

(10) Patent No.: US 7,549,415 B2
(45) Date of Patent: Jun. 23, 2009

(54) SOCCER BALL DISPENSING, STORING AND TRANSPORTING DEVICE

(76) Inventor: John J. Karellas, 7059 N. Ottawa St., Chicago, IL (US) 60631

( * ) Notice: Subject to any disclaimer, the term of this patent is extended or adjusted under 35 U.S.C. 154(b) by 880 days.

(21) Appl. No.: 10/929,951

(22) Filed: Aug. 30, 2004

(65) Prior Publication Data

US 2006/0042611 A1 Mar. 2, 2006

(51) Int. Cl.
*F41B 7/00* (2006.01)
*A63B 69/00* (2006.01)

(52) U.S. Cl. ..... 124/16; 124/36; 124/50; 124/54; 124/78; 473/446; 473/471

(58) Field of Classification Search ..... 124/16, 124/36, 50, 54, 78; 473/446, 471
See application file for complete search history.

(56) References Cited

U.S. PATENT DOCUMENTS 3,128,752 A * 4/1964 Andersen ..... 124/16
3,610,223 A * 10/1971 Green ..... 124/16
3,878,828 A * 4/1975 Francesco ..... 124/16
4,015,578 A * 4/1977 Wright ..... 124/7
4,122,822 A * 10/1978 Scheiwiller ..... 124/54
4,185,608 A * 1/1980 Young et al. ..... 124/16
4,254,755 A * 3/1981 Morgan et al. ..... 124/16
4,345,577 A * 8/1982 Andersson ..... 124/16
4,352,348 A * 10/1982 Griffith ..... 124/78
4,641,834 A * 2/1987 Hegedus et al. ..... 482/83
5,465,978 A * 11/1995 Magnone et al. ..... 124/7
5,911,214 A * 6/1999 Andrews ..... 124/16
6,488,020 B1 * 12/2002 Rosas-Magallan ..... 124/78
6,647,975 B2 * 11/2003 Whitfield ..... 124/16
6,715,477 B1 * 4/2004 Gilman ..... 124/16

FOREIGN PATENT DOCUMENTS

JP 2001029530 A * 2/2001

* cited by examiner

*Primary Examiner*—Scott E Jones
*Assistant Examiner*—Milap Shah
(74) *Attorney, Agent, or Firm*—Donald W. Meeker

(57) ABSTRACT

A wheeled cart like ball dispensing device for storing, transporting, and dispensing soccer balls by delivering soccer balls to a player in a variety of delivery modes for simulating game conditions for a player to practice responding to a variety of different shots.

9 Claims, 2 Drawing Sheets

SOCCER BALL DISPENSING, STORING AND TRANSPORTING DEVICE

BACKGROUND OF THE INVENTION

1. Field of the Invention

The present invention relates to ball dispensing devices and particularly to a wheeled cart-like device that can project soccer balls into play at various speeds, intervals and trajectories, said dispenser holds a plurality of balls and may be further used to transport and store the balls.

2. Description of the Prior Art

Games involving a game ball requires extensive practice before proper ball handling is mastered. In the example of soccer a player usually must rely on another player or a coach to repeatedly deliver the ball. However, this process is seldom similar to the actual ball trajectory in game conditions.

In response to the above problem, machines have been developed specifically for launching balls to a player for practice purposes. The prior art devices fail to provide a transporting and storing device for the balls, which also dispenses the balls in a variety of delivery modes.

U.S. Pat. No. 5,911,214, issued Jun. 15, 1999 to Andrews, provides a soccer ball projecting apparatus comprising a horizontal base frame having wheels affixed thereto for movement of the apparatus about a soccer field, and a sub-frame, which is movably mounted on the base frame. The sub-frame supports a mechanism for projecting a soccer ball, and a soccer ball support cup assembly for supporting a soccer ball in operational association with the mechanism for projecting a soccer ball. The apparatus further comprises a first chain and sprocket drive and motor for rotating the sub-frame within a horizontal plane above the base frame. The ball projecting mechanism is thereby rotatable from side to side for projecting soccer balls to soccer players on both sides of a soccer field without displacing the apparatus in the field. Other aspects of the present invention comprises the ability to adjust the striking path of the striking leg member for lobbing a ball without losing impact force on the ball, and the provision of a chain and sprocket drive for cocking a pair of springs connected to the leg member, with a detection device and a microprocessor for monitoring the number of teeth on the driven sprocket when the springs are being cocked, whereby the striking power of the leg member is adjustable by increments which are inversely proportional to the number of teeth on the driven sprocket.

U.S. Pat. No. 4,352,348, issued Oct. 5, 1982 to Griffith, describes a soccer ball practice machine that includes a pair of juxtaposed, oppositely rotating wheels for propelling a soccer ball toward a soccer player to facilitate the practice and instruction of a wide variety of soccer skills. The orientation of these wheels can be selectively varied to permit the soccer ball to be propelled in an infinite number of directions. In addition, the distance separating the rotating juxtaposed wheels can also be adjusted to accommodate soccer balls of varying diameters and can be automatically increased to prevent damage to oversized balls due to engagement by the wheels. A large hopper includes a rotating auger, which successively feeds soccer balls in the hopper into a flexible feed tube and down a rigid ball chute where they are engaged by the wheels and propelled outwardly. The flexibility of the feed tube and the rigidity of the ball chute provide accurate delivery of the balls to the wheels and confinement of the balls on all sides as they are engaged and propelled by the wheels, even though the positions of the wheels relative to the hopper may be changed to vary the direction of the ball's flight.

U.S. Pat. No. 4,122,822, issued Oct. 31, 1978 to Scheiwiller, discloses a spring-type apparatus for the projecting of footballs. Footballs are placed in a football container transferred one at a time to a football shooting station. A striking force is applied to the football. The striking force is adjustable; and its point of impact against the football is selectable. Footballs can be projected in identical manner in quick succession. The lower end of the football-striking member impacts against a football in the general area of the lowest point of the swinging movement of the football-striking member.

U.S. Pat. No. 5,465,978, issued Nov. 14, 1995 to Magnone, puts forth a training apparatus for launching balls, particularly soccer balls, of the type using a supply containing the balls. The balls are gravity fed one at a time by a chute to a launching station having an ejection arm. The lower end of the chute for supplying the balls, which opens at the level of the launching station, is provided with a single distributor for the balls. The ejection arm is mounted fixedly on an axle mounted on bearings and provided with a return spring. A launching arm is also mounted on the axle, and is actuated by a drive arm, which strikes the launching arm in rotation. The drive arm comprises adjustment element, which permits varying its radius so as to give more or less power to its lever arm. The launching station is formed by a cradle, which is provided with elements for adjustment in a horizontal direction and in a vertical direction. The apparatus is used for football training.

U.S. Pat. No. 6,647,975, issued Nov. 18, 2003 to Whitfield, is for a ball projecting apparatus having a ball singulator with a fork-and-actuator mechanism that is adjustable to allow the apparatus to be used for a variety of different sports. A fork assembly is adjustable or replaceable to convert the apparatus from use with balls of one sport to use with balls of a different sport. Each fork may be referred to as a "rocker," since it is pivoted from a first position in which a foremost ball is impeded from advancing to a second position in which the foremost ball is released, but the next ball is impeded. The rocking motion alternates which of two prongs is within the ball-supply path. When the forward prong is in the ball-supply path, all balls are prevented from advancing. Alternatively, when the rearward prong is in the ball-supply path, the foremost ball is allowed to advance.

U.S. Pat. No. 6,488,020, issued Dec. 3, 2002 to Rosas-Magallan, claims a training machine which projects a ball, such as a soccer ball, for presentation to the player. The machine propels balls with a maximum degree of freedom in selecting ball trajectories at unlimited angles, distances and velocities by mounting the propelling wheels on a plate rotatable approximately 120 degrees. The machine has an adjustable foot for adjusting the tilt of the rotatable plate. The machine is lightweight and easily assembled and disassembled for transportation and storage. An electrical control regulates the speed of each projection wheel, providing an infinite variety of spin control to the projected ball.

U.S. Pat. No. 4,345,577, issued Aug. 24, 1982 to Anderson, indicates an automatic spring type apparatus for projecting balls, preferably footballs, which apparatus includes an impact device supported in a frame and provided to convey to a ball an impulse in a direction of projection for projection thereof from a position of projection in the frame. The frame is supported in a framework for movement around a vertical axis and a horizontal axis.

What is needed is a device for storing, transporting, and dispensing soccer balls by delivering soccer balls to a player in a variety of delivery modes for simulating game conditions for a player to practice responding to a variety of different shots.

SUMMARY OF THE INVENTION

An object of the present invention is to provide a device for storing, transporting, and delivering soccer balls from a bottom chute for a ground delivery and also including two uplift devices to vary the altitude of the ball for high or bouncing launches to enable soccer players to practice receiving and responding to a variety of different shots.

Another object of the present invention is that provides a device that dispenses soccer balls to one or more players to enable players to practice in the absence of an entire team.

One more object of the present invention is that it provides a top cover over the ball receiving opening and a bottom cover over the dispensing opening to create an enclosed soccer ball storage compartment when not dispensing balls.

An additional object of the present invention is that it provides wheels mounted under the soccer cart for transporting the soccer balls to and from the playing or practice field.

A further object of the present invention is to provide a soccer ball trajectory comprises a low profile rounded bouncer adapted to modify a trajectory of a soccer ball by bouncing the soccer ball up a short distance before leaving the launching ramp so that the soccer ball bounces out of the launching ramp and bounces away from the device to a receiving player.

A contributory object of the present invention is to provide a spring-loaded or hydraulic launching device to strike a soccer ball and move it along the launching ramp and onto a ground surface.

An ancillary object of the present invention is that it provides a passageway and launching ramp for the soccer balls that are wider than the soccer balls, so that the soccer balls land in front of the launching device at different positions which causes the device to dispense soccer balls at different angles.

An added object of the present invention is that it provides a timer device for determining a time of launch of soccer balls and for dispensing soccer balls at different time intervals.

Yet another object of the present invention is that it provides a lofting element adapted to modify a trajectory of a soccer ball by pushing the soccer ball upward to loft the soccer ball leaving the launching ramp so that the soccer ball flies up in the air off of the launching ramp and flies in the air away from the device to a receiving player.

In brief, the present invention would have a dual or single dispenser that would project soccer balls into play so one or more players can practice receiving the soccer balls to commence play with the ball. The unit can dispense soccer balls in three different types of passes; a standard surface pass, a bouncing ball pass, and an elevated pass so a player can work on headers and redirection. The three different types of passes are to help players improve by simulating what they may encounter in game-like situations.

An advantage of the present invention is that it enables soccer players to practice receiving and responding to a variety of different shots, including ground, bouncing, and airborne soccer balls.

Another advantage of the present invention is that it enables players to practice in the absence of an entire team.

An additional advantage of the present invention is that it stores and transports a number of soccer balls.

A further advantage of the present invention is that it can be set to determine time of launch and time intervals of launch for the soccer balls.

Another advantage of the present invention is that it dispenses soccer balls at different angles.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
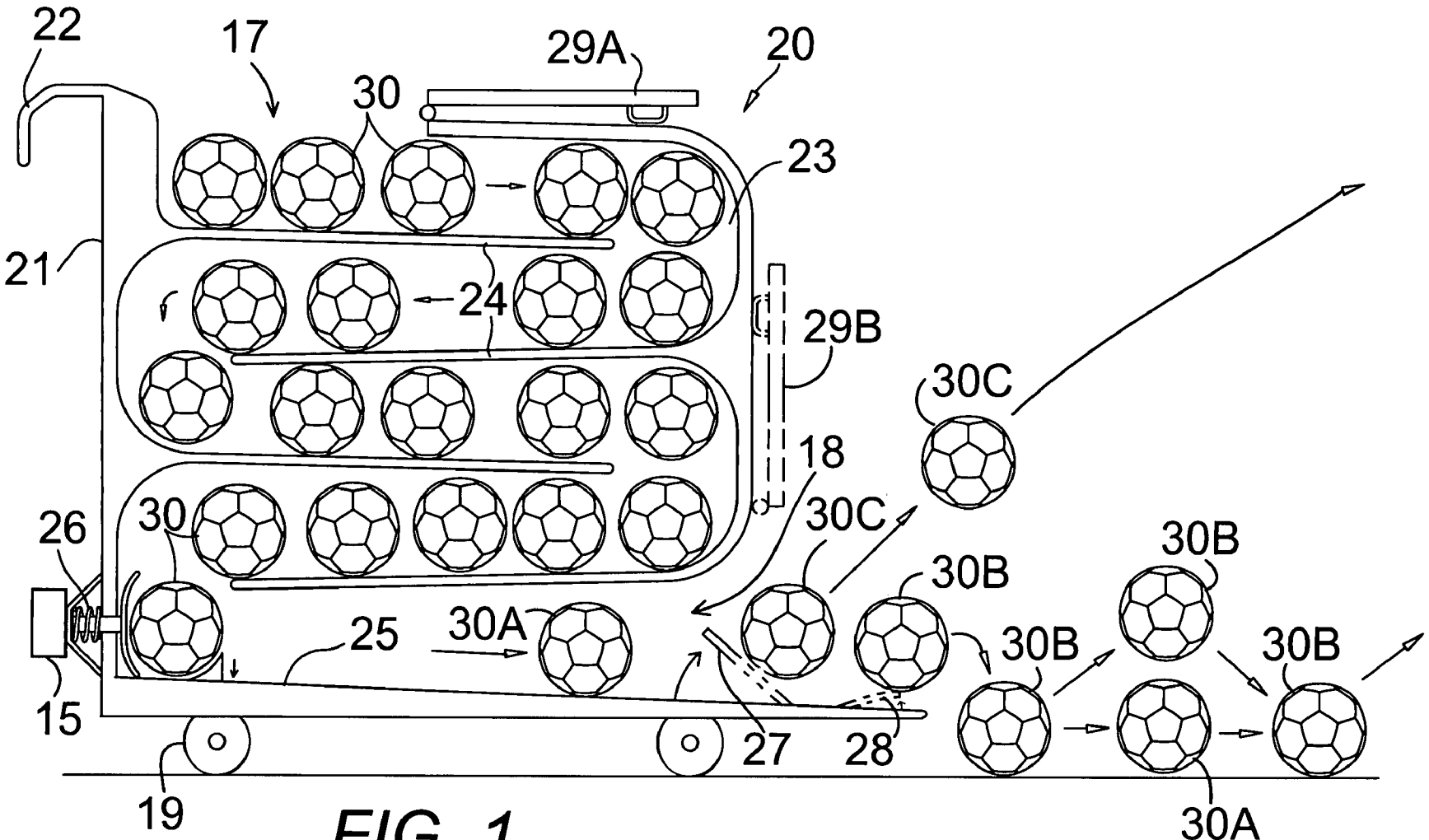
FIG. 1 is a side elevational view in partial section showing the soccer ball dispensing, storing and transporting device of the present invention showing three different ball delivery launches.
Figure 2:
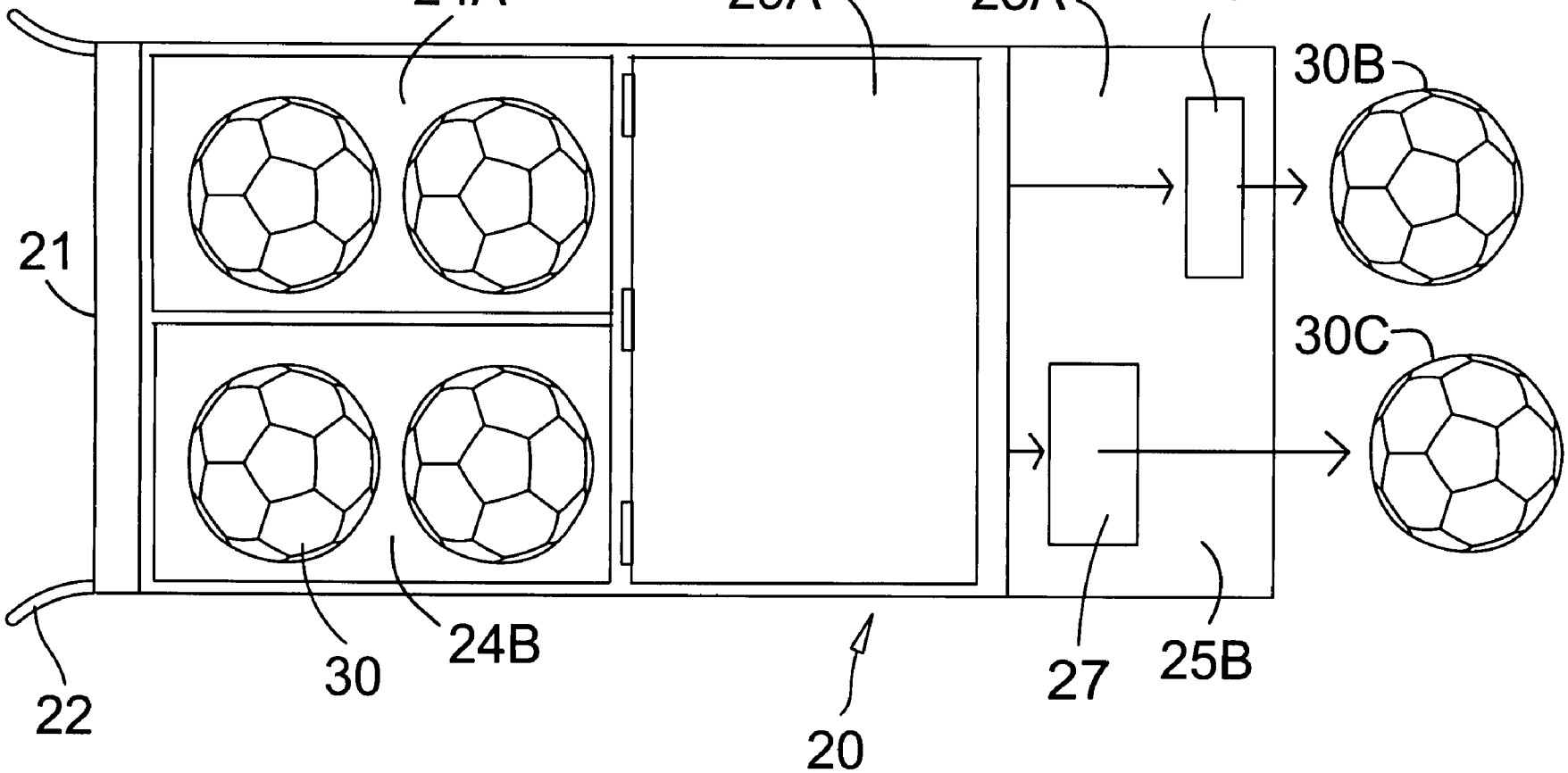
FIG. 2 is a top plan view of the soccer ball dispensing, storing and transporting device of FIG. 1.

In FIGS. 1 and 2, a soccer ball dispensing device 20 delivers soccer balls 30 in a variety of delivery modes and also functions to store and transport soccer balls.

The device comprises a soccer ball cart 21 that comprises a top cover with a sliding or hinged door 29A, side walls, and a bottom support with a hollow interior 23 adapted for receiving, storing and dispensing a number of soccer balls 30. A top receiving opening 17 in the top cover is adapted to admit soccer balls 30 into the cart interior and at least one bottom-dispensing opening 18 in the bottom support is adapted to dispense soccer balls (as seen in FIG. 1). At least one descending sloping ramp 24 inside the soccer ball cart is adapted to guide soccer balls 30 downwardly in at least one linear array between the receiving opening 17 and the dispensing opening 18. A launching ramp 25 extends outwardly from the dispensing opening and a hydraulic or spring-loaded device 26 launches soccer balls 30 along the launching ramp 25 and away from the soccer ball cart 21. The launching ramp 25 has an outer end adjacent to a ground level so that the launching ramp is adapted to launch the soccer balls 30A rolling along a ground surface away from the device to a receiving player.

A soccer ball dispenser such as a spring-loaded device 26 or hydraulic device launches the soccer balls 30 along the launching ramp by striking a soccer ball 30 and moving it along the launching ramp 25 and onto a ground surface for a rolling delivery of a soccer ball 30A. A timer device 15 connected to and controlling the soccer ball dispenser determines a time to launch the soccer balls and time interval between launches.

The soccer ball dispenser cart 21 dispenses soccer balls 30 at various speeds, different time intervals, and different angles depending on the position of the soccer balls in front of the launching device 26.

One means for altering a path of a soccer ball trajectory to deliver a soccer ball to a player in a different delivery mode comprises a low profile rounded bouncer movable element 28 in the launching ramp 25 adjacent to an end of the launching ramp. The bouncer movable element 28 is adapted to modify a trajectory of a soccer ball by bouncing the soccer ball 30B up a short distance before leaving the launching ramp so that the soccer ball bounces out of the launching ramp and bounces away from the device to a receiving player.

Another means for altering a path of a soccer ball trajectory comprises a high profile lofter movable element 27 in the launching ramp 25 adjacent to an end of the launching ramp.

The lofter movable element 27 is adapted to modify a trajectory of a soccer ball by pushing the soccer ball 30C upward to loft the soccer ball leaving the launching ramp so that the soccer ball flies up in the air off of the launching ramp and flies in the air away from the device to a receiving player.

The means for launching the soccer balls 26 is adapted to strike the soccer balls 30 one at a time and the at least one descending sloping ramp 24, the dispensing opening 18, and the launching ramp 25 are each wider than a soccer ball 30 so that the soccer balls 30 arrive in front of the means for launching the soccer balls 26 at different positions and the means for launching the soccer balls 26 strikes the soccer balls at different angles so that the device is adapted for dispensing soccer balls at different angles.

The soccer ball dispenser cart 21 comprises at least one top door 29A that movably mounts to the device over the top receiving opening 17 and may have a bottom door 29B (shown dashed) that movably mounts to the device over a soccer ball dispensing opening 18 so that the device is adapted to be used as a storage unit for soccer balls when not being used for practice.

A set of wheels 19 are mounted under the soccer cart 21 for transporting the soccer balls 30.

The soccer ball dispenser cart 21 preferably comprises two descending sloping ramps inside the soccer ball cart 21, as seen in FIG. 2, adapted to guide soccer balls downwardly in two linear arrays between the receiving opening 17 and the dispensing opening 18, and two launching ramps 25A and 25B, which may each have a different means for altering the path of trajectory of the soccer balls 27 and 28.

In use, the wheeled soccer ball dispensing cart 21 stores, transports and dispenses soccer balls 30 to players for practice. It can launch the soccer balls rolling flat 30A on the ground, bouncing on the ground 30B or flying in the air 30C.

It is understood that the preceding description is given merely by way of illustration and not in limitation of the invention and that various modifications may be made thereto without departing from the spirit of the invention as claimed.

What is claimed is:

1. A soccer ball dispensing device for delivering soccer balls in a variety of delivery modes and for storing and transporting soccer balls, the device comprising:

a soccer ball cart comprising a top cover, side walls, and a bottom support with a hollow interior adapted for receiving, storing and dispensing a number of soccer balls, a top receiving opening in the top cover adapted to admit soccer balls into the cart interior, at least one bottom dispensing opening in the bottom support adapted to dispense soccer balls, at least one descending sloping ramp inside the soccer ball cart adapted to guide soccer balls downwardly in at least one linear array between the receiving opening and the dispensing opening, a launching ramp extending outwardly from the dispensing opening, a means for launching soccer balls along the launching ramp and away from the soccer ball cart, the launching ramp having an outer end adjacent to a ground level so that the launching ramp is adapted to launch the soccer balls rolling along a ground surface away from the device to a receiving player;

means for altering a path of a soccer ball trajectory along the launching ramp built into the launching ramp to deliver a soccer ball to a player in a different delivery mode comprising a low profile rounded bouncer movable element in the launching ramp adjacent to an end of the launching ramp, the bouncer movable element adapted to modify a trajectory of a soccer ball by bouncing the soccer ball up a short distance before leaving the launching ramp so that the soccer ball bounces out of the launching ramp and bounces away from the device to a receiving player and a high profile lofter movable element in the launching ramp adjacent to an end of the launching ramp, the lofter movable element adapted to modify a trajectory of a soccer ball by pushing the soccer ball upward to loft the soccer ball leaving the launching ramp so that the soccer ball flies up in the air off of the launching ramp and flies in the air away from the device to a receiving player;

wheels mounted under the soccer cart for transporting the soccer cart, thereby providing a mobile soccer ball dispensing device for delivering soccer balls in a variety of delivery modes and for storing and transporting soccer balls.

2. The device of claim 1 wherein the means for launching soccer balls along the launching ramp comprises a spring loaded device to strike a soccer ball and move it along the launching ramp and onto a ground surface.

3. The device of claim 1 wherein the means for launching soccer balls along the launching ramp comprises a hydraulic system to strike a soccer ball and move it along the launching ramp and onto a ground surface.

4. The device of claim 1 wherein the means for launching soccer balls along the launching ramp further comprises a timer device for determining a time of launch of soccer balls.

5. The device of claim 1 wherein the means for launching soccer balls along the launching ramp further comprises a timer for determining time intervals between launches of soccer balls.

6. The device of claim 1 further comprising a means for adjusting the intensity of the means for launching soccer balls along the launching ramp for dispensing soccer balls at various speeds.

7. The device of claim 1 wherein the means for launching the soccer balls is adapted to strike the soccer balls one at a time and the at least one descending sloping ramp, the dispensing opening, and the launching ramp are each wider than a soccer ball so that the soccer balls arrive in front of the means for launching the soccer balls at different positions and the means for launching the soccer balls strikes the soccer balls at different angles so that the device is adapted for dispensing soccer balls at different angles.

8. The device of claim 1 further comprising at least one door movably mounted to the device over the top receiving opening and at least one door movably mounted to the device over a soccer ball dispensing opening so that the device is adapted to be used as a storage unit for soccer balls when not being used for practice.

9. The device of claim 1 comprising two descending sloping ramps inside the soccer ball cart adapted to guide soccer balls downwardly in two linear arrays between the receiving opening and the dispensing opening, and two launching ramps.

* * * * *